US006612856B1

(12) United States Patent
McCormack

(10) Patent No.: US 6,612,856 B1
(45) Date of Patent: Sep. 2, 2003

(54) APPARATUS AND METHODS FOR PREVENTING CABLE-DISCHARGE DAMAGE TO ELECTRONIC EQUIPMENT

(75) Inventor: Michael Sean McCormack, Gloucester, MA (US)

(73) Assignee: 3Com Corporation, Santa Clara, CA (US)

( * ) Notice: Subject to any disclaimer, the term of this patent is extended or adjusted under 35 U.S.C. 154(b) by 0 days.

(21) Appl. No.: 10/023,009

(22) Filed: Dec. 17, 2001

(51) Int. Cl.[7] ..... H01R 29/00

(52) U.S. Cl. ..... 439/188; 439/676; 439/108; 200/51.1

(58) Field of Search ..... 439/188, 676, 439/181, 108; 200/51.1

(56) References Cited

U.S. PATENT DOCUMENTS

| | | | | | |
|---|---|---|---|---|---|
| 4,506,944 | A | * | 3/1985 | Brennan et al. | 439/607 |
| 4,516,825 | A | * | 5/1985 | Brennan et al. | 439/607 |
| 4,552,423 | A | * | 11/1985 | Swengel, Jr. | 439/188 |
| 4,695,115 | A | * | 9/1987 | Talend | 439/76 |
| 4,767,355 | A | * | 8/1988 | Phillipson et al. | 439/188 |
| 4,969,836 | A | * | 11/1990 | Magnier et al. | 439/188 |
| 5,030,123 | A | * | 7/1991 | Silver | 439/188 |
| 5,494,463 | A | * | 2/1996 | Nishio et al. | 439/181 |

FOREIGN PATENT DOCUMENTS

| | | | | |
|---|---|---|---|---|
| WO | WO 86/00474 | * | 1/1986 | 439/188 |

* cited by examiner

*Primary Examiner*—Tho D. Ta
*Assistant Examiner*—Larisa Tsukerman
(74) *Attorney, Agent, or Firm*—Michaelson & Wallace; Peter L. Michaelson

(57) ABSTRACT

A connector assembly for protecting against cable discharge with respect to static charges that may accumulate on cables and other conductors. The connector assembly comprises a modular plug that mates with a modular jack. The modular jack comprises a plurality of resilient contacts that connect to rigid contacts on the modular plug when the plug and jack mate. The modular jack also supports a grounding conductor such that the jack contacts connect to ground when the jack and plug are unmated. As the plug and jack begin to mate, the jack contacts connect a ground potential to the plug contacts, thereby discharging to ground any static charge that may be stored on the cable. As the jack and plug continue to mate, the plug contacts disconnect the jack contacts from the grounding conductor. When the jack fully mates with the plug, cable conductors connect to an electronic circuit via the jack and plug contacts. The grounded contacts of a jack will steadily prevent charges from accumulating on cables or other conductors connected to the jack as long as the jack remains unmated. In a first embodiment, an electromagnetic shield, which connects the grounding conductor to a ground potential, covers the jack body. In a second embodiment, each of a plurality of grounding conductors connects to a different jack contact.

3 Claims, 4 Drawing Sheets

APPARATUS AND METHODS FOR PREVENTING CABLE-DISCHARGE DAMAGE TO ELECTRONIC EQUIPMENT

BACKGROUND OF THE INVENTION

1. Field of the Invention

The invention relates generally to techniques for protecting electronic circuits from damage due to cable discharge. More particularly, it relates to apparatus and methods for safely terminating electronic cables and/or providing points of entry to electronic circuits.

2. Description of the Prior Art

Cable discharge can be a serious problem for installers of electronic systems. Cable discharge generally results from an electrical phenomenon wherein cables in an electrical system build up large and potentially damaging electric charges, not unlike static electricity. These stored charges are often the result of processes that are currently not well understood in the art. Consequently, when an installer connects a piece of electronic equipment to a system cable, that cable could hold an unforeseen electric charge, and that charge could readily dissipate into that piece of equipment. Thus, when an installer initially connects an electronic component to a system cable, the component can unexpectedly receive a large, destructive discharge of electricity.

Telecommunications, data communications and electronic networking systems, which are particularly susceptible to damage from cable discharge, employ various kinds of connector circuits for cabling equipment together. For example, a modular connector, i.e., a modular jack along with its corresponding modular plug, is one well-known type of connector that has found widespread use in many communication and networking systems. Modular connectors are easy to use. Users can couple and uncouple most connectors without tools and with little manual effort. In addition, modular connectors are generally durable, reliable, and inexpensive to manufacture and install.

A typical modular jack, a female connector, comprises multiple electrical conductors contained within a cavity of a molded plastic body. The jack conductors act as electrical contacts, which mate with corresponding contacts on a modular plug, a male connector that inserts into a jack cavity. A modular plug normally terminates a cable segment. A modular jack, which may also terminate a cable segment, primarily mounts on a rigid support, e.g., a printed circuit board (PCB), a chassis of an electronic apparatus, or a cable termination device located in a telecommunications closet.

Conventional modular connectors include four-wire RJ-11, six-wire RJ-12 and eight-wire RJ-45 connectors. A variety of telecommunication, data communication and networking equipment contain RJ-45 connectors. For instance, conventional LAN (local area network) systems, such as Ethernet systems, often use RJ-45 connectors to make cable connections between computers and other LAN devices dispersed over an area, such as an office building.

Although most cable connectors, including modular connectors, have served the purpose in the past, installers of electronic equipment still encounter cable discharge problems. Thus, there is a need in the art for techniques to overcome problems related to cable discharge.

SUMMARY OF THE INVENTION

The present invention satisfies this need in the art by providing apparatus and methods for safely terminating electronic cables and/or providing points of entry to electronic circuits. One aspect of the invention comprises a connector assembly that prevents damage caused by cable discharge when a system cable connects to an electronic circuit having a source of ground potential. The connector assembly comprises first and second connectors, each having a plurality of contacts, and a device for mating the connectors such that corresponding contacts connect to each other. A grounding device briefly connects all of the contacts to the ground potential when the connectors initially or partially mate, and removes the contacts from the ground potential when the connectors fully mate.

Another aspect of the invention involves a connector assembly comprising a first connector having a plurality of rigid contacts and a second connector having a plurality of resilient contacts. The connector also includes apparatus for mating the first and second connectors such that each of the rigid contacts connect to and flex a different one of the resilient contacts when the connectors mate. A ground device grounds the resilient contacts when the connectors are unmated, grounds the resilient and rigid contacts when the connectors are partially mated, and disconnects the resilient and rigid contacts from ground when the connectors are fully mated.

In addition, the second connector includes a body having a cavity with an access opening. The resilient contacts mount in the cavity, and a grounding conductor mounts on the body in contact with the resilient contacts. The first connector includes a plug shaped to fit within the cavity when the first and second connectors mate.

One embodiment of the invention includes an electromagnetic shield that covers the body and connects the grounding conductor to a ground potential. In another embodiment, the ground device includes a plurality of grounding conductors, each connected to a different one of the resilient contacts and disconnects from the rigid contacts when the connectors are unmated. The grounding contacts connect to a different one of the contacts when the connectors partially mate, and disconnect from the contacts when the connectors fully mate. In addition, the connector assembly functions as an eight-contact, RJ-45 connector, and the first connector is a modular plug while the second connector is a modular jack.

A further aspect of the invention comprises a method of connecting a cable terminated in a first set of contacts to an electronic circuit having a second set of contacts and a ground potential. The method comprises the steps of: connecting the second set of contacts to the ground potential; connecting the first set of contacts to the second set of contacts while the second set of contacts remain connected to the ground potential; and disconnecting the first and second sets of contacts from the ground potential while the first set of contacts remain connected to the second set of contacts.

BRIEF DESCRIPTION OF THE DRAWINGS

The teachings of the present invention can be readily understood by considering the following detailed description in conjunction with the accompanying drawings, in which.

DETAILED DESCRIPTION OF THE PREFERRED EMBODIMENT

Figure 1:
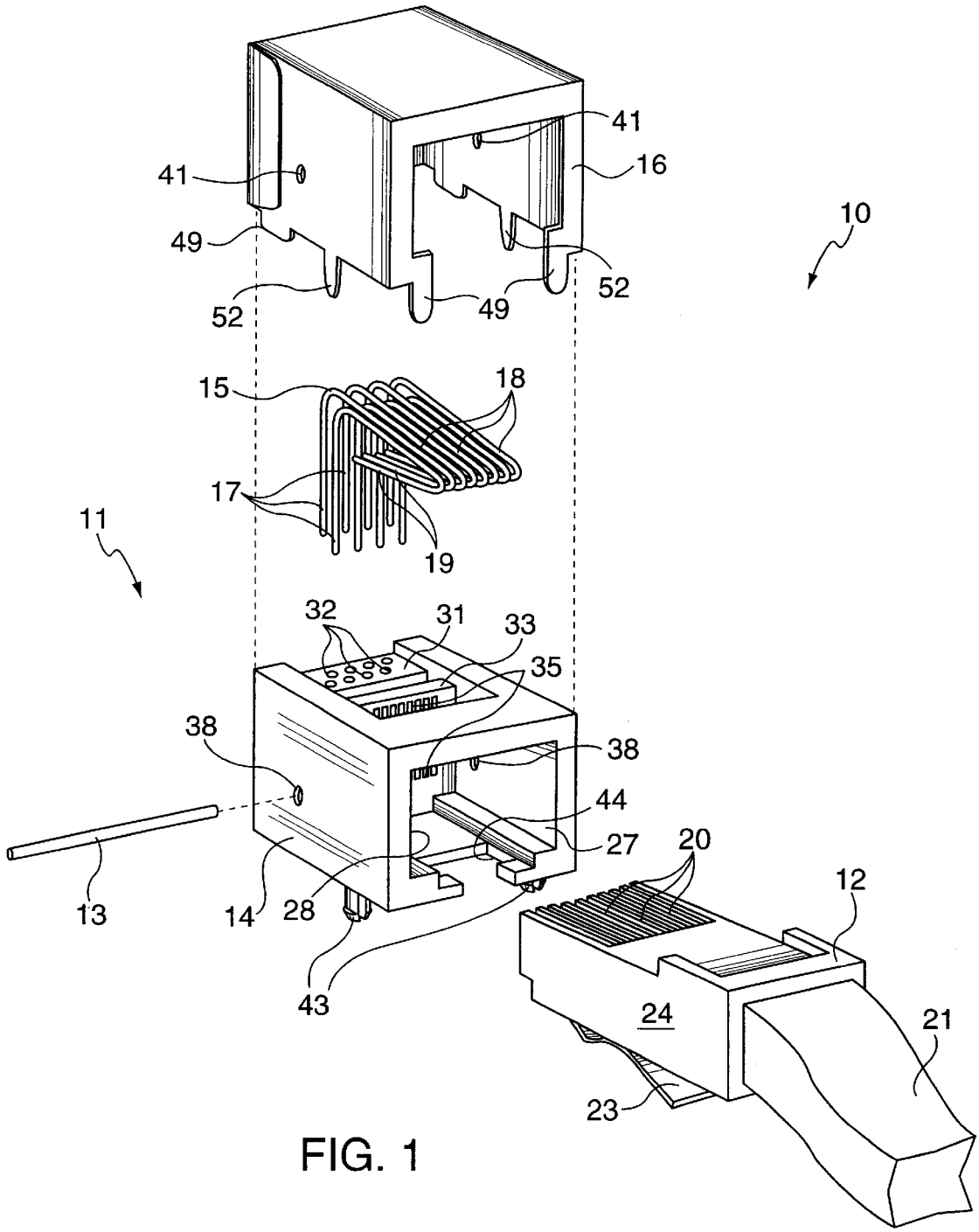
FIG. 1 is an exploded pictorial view of a modular connector in accordance with the present invention.
Figure 2:
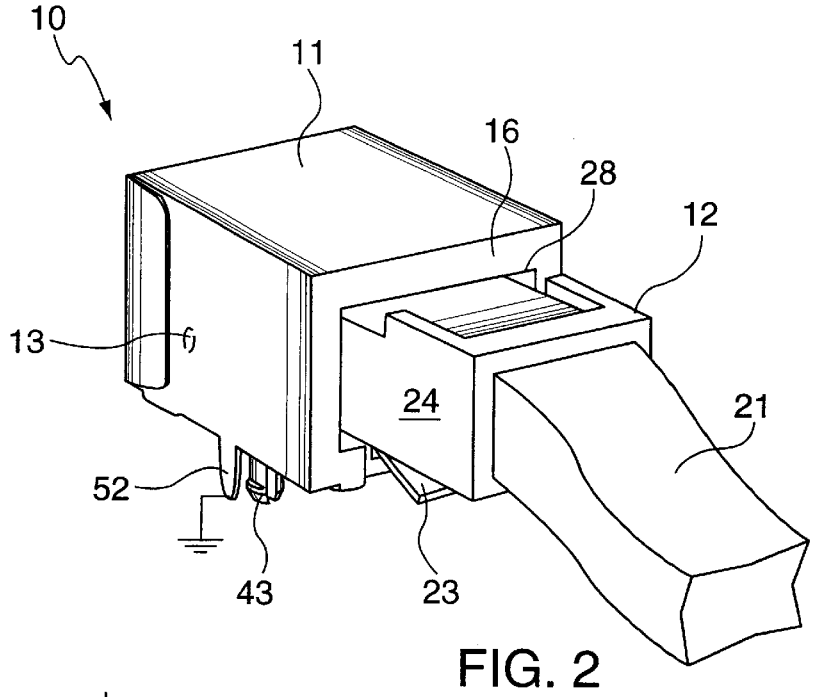
FIG. 2 is a pictorial view of the connector of FIG. 1 showing the modular plug mated with the modular jack.
Figure 3:
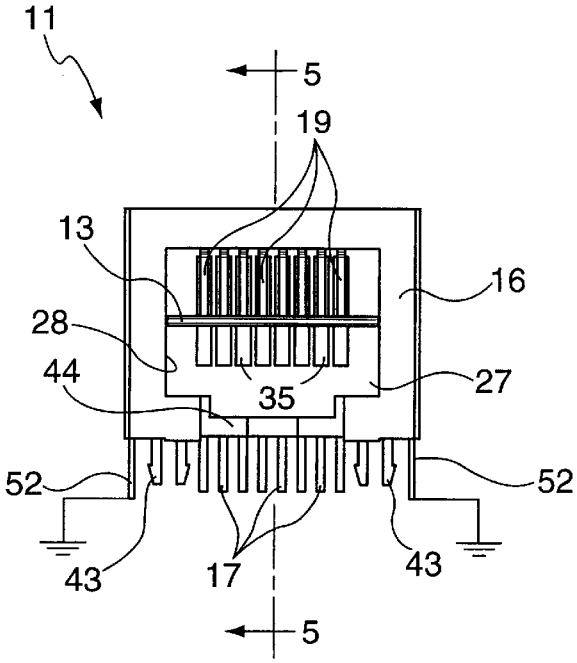
FIG. 3 is a front elevation of the modular jack of FIGS. 1 and 2.
Figure 4:
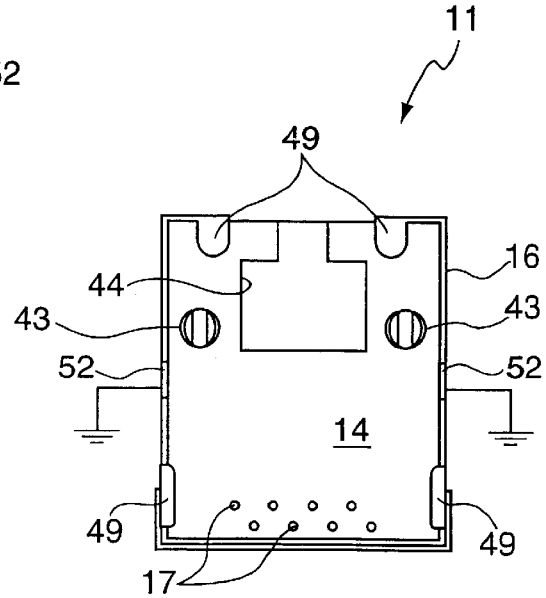
FIG. 4 is a bottom view of the modular jack of FIG. 3.

For illustrative purposes, the invention is described and depicted with respect to a device designed to function as an eight-contact, RJ-45 connector. As will become evident from the following teachings, however, those skilled in these arts can readily apply the invention to a variety of connectors used with computer, networking, telecommunication, and like systems.

FIGS. 1–6 show shielded modular connector 10 having modular jack 11 and corresponding modular plug 12. Modular jack 11 includes molded plastic body 14, metallic grounding bar 13, eight electrical conductors 15, and electric shield 16. Modular plug 12 is a conventional device that selectively mates with modular jack 11. Generally, modular plug 12 joins eight conductors (not shown) in system cable 21 to eight plug contacts 20 supported in plastic molded body 24. Modular plug 12 also includes a conventional resilient fastener clip 23 for keeping plug 12 fast in modular jack 11 when these items mate (see FIGS. 2 and 6).

Electrical conductors 15 each comprise a wire having a vertical lead 17, a horizontal arm 18 and a downwardly bent, resilient, jack contact 19. Lead 17, arm 18 and jack contact 19 lie in a common plane.

Plastic body 14 comprises cavity 27 with a generally rectangular opening 28 for receiving modular plug 12. Rear panel 31 of body 14 has eight vertical bores 32 for receiving and retaining the eight vertical leads 17. Vertical partition 33, spaced in front of panel 31, has eight parallel slots 35 for receiving the free ends of jack contacts 19. The opposite side walls of body 14 contain coaxial, horizontal bores 38, which align with each other and with corresponding bores 41 in the side walls of shield 16. Bores 38 and 41 support grounding bar 13 in a manner described below in detail. Mounting posts 43 depend from opposite sides of the bottom wall of body 14. T-shaped fastener slot 44, formed in the bottom wall of body 14, mates with resilient fastening clip 23 in a manner well known in the art (see FIGS. 2 and 6).

Electric shield 16, preferably stamped and formed from sheet metal, has four retaining tabs 49 that secure shield 16 to body 14. Mounted on either side of shield 16 are grounding legs 52. As depicted schematically in FIGS. 2–4, legs 52 connect shield 16 to a source of ground potential.

When employing modular connector 10 as a shielded RJ-45 connector in a network and/or telecommunication environment, leads 17 will typically carry data and/or control signals that often have energy components in the RF (radio frequency) range. Thus, grounded shield 16, which shields a substantial portion of jack 11, will suppress most RF radiation that may emit from the conductors in modular connector 10.

With reference to FIG. 1, the components of modular jack 11 fit together by first mounting conductors 15 within body 14. The free ends of jack contacts 19 insert into different slots 35 while leads 17 feed into the upper ends of corresponding bores 32. Suitable cement anchors the eight leads 17 in bores 32. Shield 16 slides over the top of plastic body 14. With shield 16 fully seated on body 14, retaining tabs 49 bend into place under body 14 (see FIG. 4). At this point bores 38 and 41 align, forming horizontal bearings in which the opposite ends of grounding bar 13 sit.

Before installing grounding bar 13, however, the installer lifts jack contacts 19 upward by, for example, partially inserting modular plug 12 into jack cavity 27. As modular plug 12 moves into cavity 27, plug contacts 20 flex jack contacts 19 upward, thereby making room under jack contacts 19 for grounding bar 13 to slide into bores 38 and 41. The ends of grounding bar 13 are soldered to shield 16 to fix grounding bar 13 in place and establish a good electrical contact with shield 16. When modular plug 12 separates from jack 11, the free ends of jack contacts 19 spring down and firmly rest on grounding bar 13 (see FIGS. 3 and 5).

Figure 5:
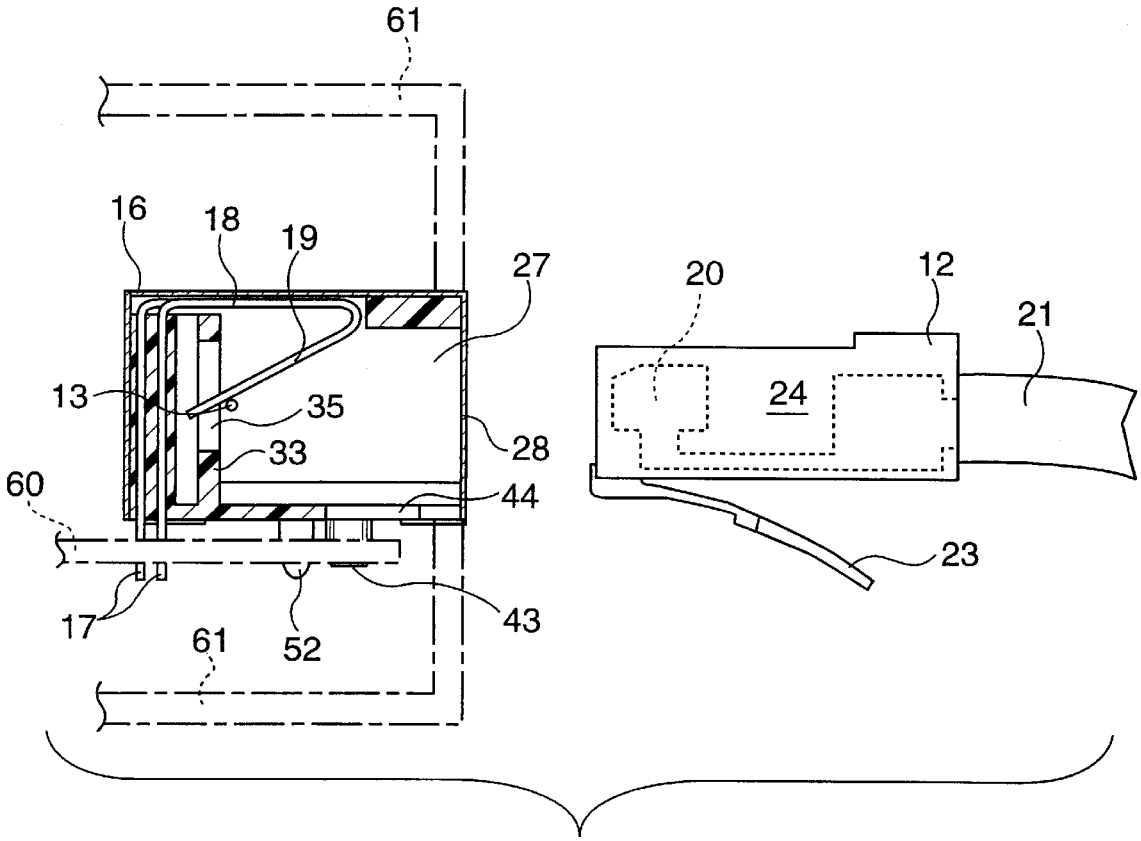
FIG. 5 comprises a sectional view taken on the line 5—5 of FIG. 3 and looking in the direction of the arrows, a side elevation of the modular plug of FIGS. 1 and 2, and a phantom schematic of an electronic device.
Figure 6:
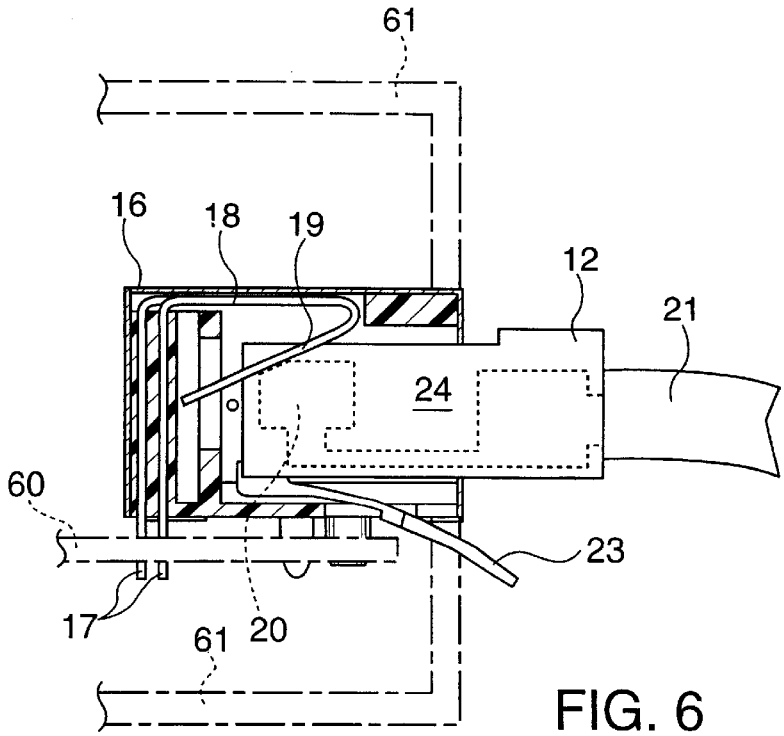
FIG. 6 is a view similar to FIG. 5, showing the modular plug mated with the modular jack of FIG. 5.

FIGS. 5 and 6 schematically and illustratively depict modular jack 11 mounted on PCB (printed circuit board) 60 located in electronic device 61. Other mounting configurations will be apparent in view of the present teachings. Indeed, modular jack 11 could mount on a piece of cable termination hardware. In the latter case, leads 17 would normally connect to cable conductors carrying data and/or control signals while grounding legs 52 connect to a ground potential via a grounded cable conductor or other ground source.

With respect to the PCB mounting configuration of FIGS. 5 and 6, mounting posts 43 mate with corresponding mounting holes (not shown) in PCB 60. In addition to supporting modular jack 11, PCB 60 typically comprises other electronic components as well as an array of printed conductors, including a grounding conductor or ground plane. In addition, conventional circuit connectors, such as through holes, solder pads, etc. will normally form a part of the printed circuit on PCB 60. For clarity, FIGS. 5 and 6 do not show these conventional circuit components.

In a typical application, for example, in a LAN environment, leads 17 normally connect to PCB conductors that carry data and/or control signals, while grounding legs 52 connect to a grounded conductor or ground plane on PCB 60. The grounding of shield 16 via legs 52 also grounds bar 13. Thus, when plug 12 and jack 11 are unmated, bar 13 connects jack contacts 19 to a ground potential on PCB 60. Jack contacts 19 remain grounded as long as they remain in contact with grounding bar 13. Jack contacts 19 will normally remain in contact with grounding bar 13 as long as plug 12 and jack 11 remain unmated. Whenever plug 12 mates with jack 11, plug contacts 20 flex jack contacts 19 up and away from grounding bar 13. However, once that plug contacts 20 initially touch corresponding jack contacts 19, i.e., just before jack contacts 19 separate from bar 13, plug contacts 20 will connect to the ground potential along with the corresponding conductors in cable 21. Consequently, each time that modular connector 10 initially connects cable 21 to electronic device 61, stored charges on cable 21 will safely discharge to ground. Specifically, before plug 12 fully mates with jack 11, stored charges on cable 21 discharge to ground via plug contacts 20, jack contacts 19, grounding bar 13, shield 16 and legs 52 grounded on PCB 60.

With respect to cables or other conductors that connect to an unmated jack 11 via leads 17, the present invention will also provide protection from cable discharge. As explained above, jack contacts 19 remain grounded as long as they remain in contact with grounding bar 13, i.e., as long as plug 12 and jack 11 remain unmated. Thus, when jack 11 is unmated, any charges that an attached conductor or cable may accumulate will be immediately bled off to ground via jack contacts 19 and grounding bar 13. Consequently, when equipment installers connect electronic equipment to system cables using connector 10, they will be assured of protection from cable discharge with respect to cables on the jack side as well as the plug side of the connector.

Figure 7:
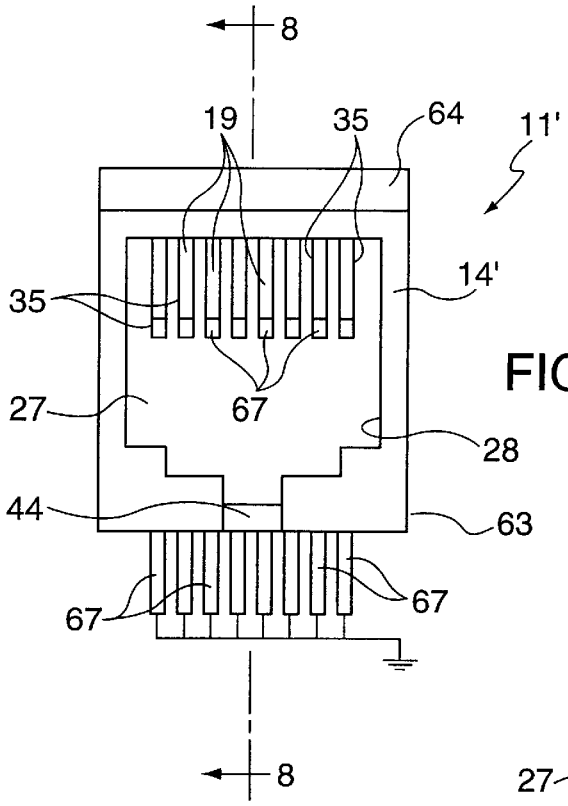
FIG. 7 is a front elevation of an alternate embodiment of a modular jack in accordance with the present invention.
Figure 8:
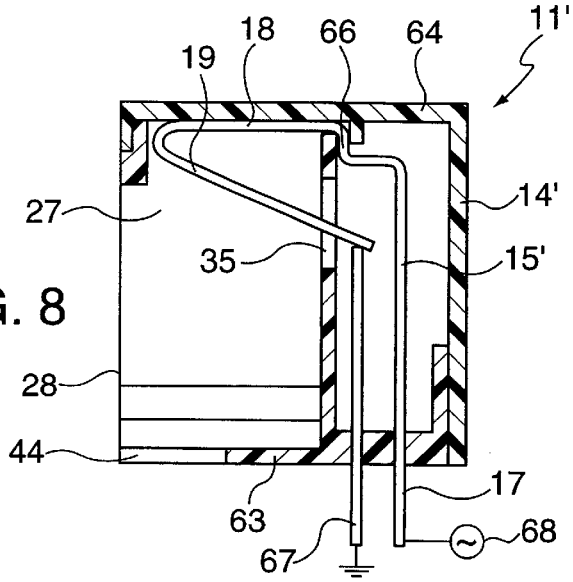
FIG. 8 is a sectional view taken on the line 8—8 of FIG. 7 and looking in the direction of the arrows.
Figure 9:
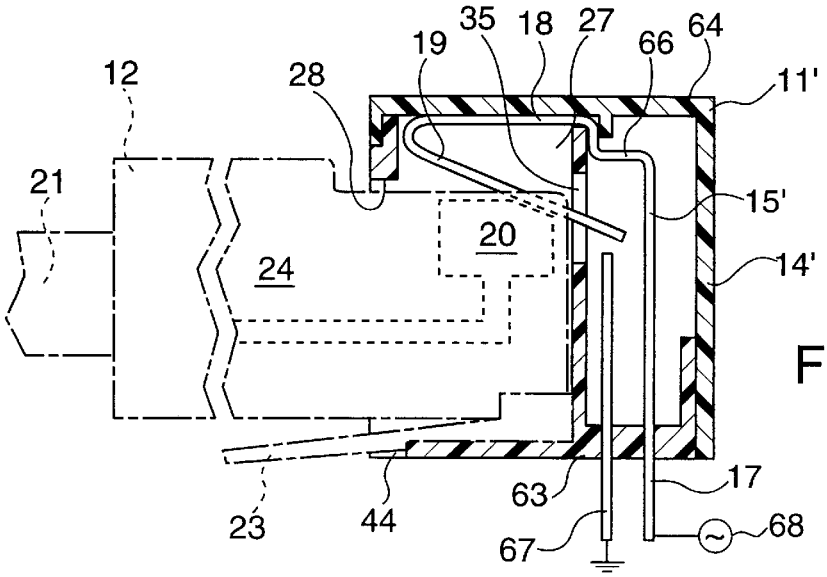
FIG. 9 is a view similar to FIG. 8 with a phantom depiction of the modular plug of FIG. 1 mated with the modular jack of FIGS. 7 and 8.

Obviously many modifications and variations of the invention are possible in the light of the above teachings. For instance, FIGS. 7–9 depict an alternate embodiment directed to unshielded modular jack 11'. Modular jack 11' includes modified molded body 14' having forward section 63 and rear section 64 cemented together to form cavity 27 with opening 28. Section 63 includes a vertical wall having slots 35, which accommodate the free ends of jack contacts 19. In addition to jack contact 19, arm 18 and lead 17, each modified conductor 15' includes bent portion 66. Conductors 15' are secured in body 14' by cementing leads 17 within bores in section 63, while bent portion 66 is gripped between sections 63 and 64. The free ends of jack contacts 19 extend through slots 35 into contact with vertical grounding leads 67, which are also cemented in bores in section 63. As depicted schematically, leads 67 connect to ground while leads 17 connect to signal sources 68.

FIG. 8 illustrates jack 11' and plug 12 unmated. In an unmated state, jack contacts 19 touch the upper ends of grounding leads 67, thereby grounding jack contacts 19. As plug 12 initially mates with jack 11' (see FIG. 9), each jack contact 19 will briefly ground a corresponding plug contact 20 before jack contacts 19 flex up and away from grounding leads 67. Thus, each time that plug 12 initially connects cable 21 to signal source 68 via modular jack 11', stored charges on cable 21 will safely discharge to ground. More specifically, before plug 12 fully mates with jack 11' stored charges on cable 21 discharge to ground via plug contacts 20, jack contacts 19 and grounding leads 67, thereby preventing damage from cable discharge. Again, the grounded contacts 19 of an unmated jack 11 will prevent charges from accumulating on cables or other conductors connected to the jack.

Various other modifications of the invention are contemplated. It is to be understood, therefore, that within the scope of the appended claims, the invention may be practiced otherwise than as specifically described.

What is claimed is:

1. A connector assembly for connecting a cable to an electronic circuit having a ground potential, said assembly comprising:

a jack connector comprising:

a body having a cavity with an opening;

a wall, with a plurality of guide slots, mounted in said body forming a chamber communicating with said cavity via said guide slots;

a plurality of jack conductors mounted on said body, each said jack conductor having a contact end that protrudes from said cavity into said chamber via a corresponding one of said guide slots, a rigid end that protrudes from said body to form a first set of PCB (printed circuit board) lead connectors exterior of said body, and a resilient intermediate section that resides within said cavity; and a plurality of spaced, parallel, linear grounding posts rigidly mounted on said body, a first end of each said linear grounding post located in said chamber adjacent a corresponding one of said contact ends of said jack conductors, and a second end of each said linear grounding post protruding from said body adjacent said first set of PCB lead connectors to form a second set of spaced PCB lead connectors exterior of said body;

a plug connector having a plurality of plug contacts, and means for mating said plug connector with said jack connector via said opening such that each of said plug contacts connects to a corresponding one of said jack conductors;

a grounded conductor connecting said second set of PCB lead connectors directly to said ground potential; and grounding means for connecting said jack conductors to said ground potential via said linear grounding posts when said jack and plug connectors are unmated, for briefly connecting said plug contacts to said ground potential via said jack conductors and said linear grounding posts when said jack and plug connectors are partially mated, and for disconnecting said plug contacts and said jack conductors from said ground potential when said jack and plug connectors are mated.

2. The assembly of claim 1 wherein said body includes first and second molded sections cemented together to form said cavity and said chamber, said first section including said wall and having bores for rigidly supporting said first and second sets of said PCB connectors.

3. The assembly of claim 2, wherein said connector assembly is an unshielded, eight-contact RJ-45 connector.

* * * * *